US008368709B2

(12) United States Patent
Nurmi

(10) Patent No.: US 8,368,709 B2
(45) Date of Patent: Feb. 5, 2013

(54) METHOD AND APPARATUS FOR DISPLAYING ONE OR MORE PIXELS

(75) Inventor: Juha Harri-Pekka Nurmi, Salo (FI)

(73) Assignee: Nokia Corporation, Espoo (FI)

( * ) Notice: Subject to any disclaimer, the term of this patent is extended or adjusted under 35 U.S.C. 154(b) by 631 days.

(21) Appl. No.: 12/562,745

(22) Filed: Sep. 18, 2009

(65) Prior Publication Data

US 2011/0069075 A1 Mar. 24, 2011

(51) Int. Cl.
*G09G 5/36* (2006.01)

(52) U.S. Cl. ..... 345/545; 345/204; 345/214

(58) Field of Classification Search ..... None
See application file for complete search history.

(56) References Cited

U.S. PATENT DOCUMENTS

| | | | | |
|---|---|---|---|---|
| 5,945,972 | A | 8/1999 | Okumura et al. | 345/90 |
| 6,124,850 | A * | 9/2000 | Matsubara | 345/204 |
| 6,339,417 | B1 | 1/2002 | Quanrud | 345/98 |
| 7,068,251 | B2 | 6/2006 | Lin et al. | 345/87 |
| 2002/0167510 | A1 | 11/2002 | Matsumoto | 345/211 |
| 2003/0098860 | A1 | 5/2003 | Nakamura et al. | 345/211 |
| 2003/0142056 | A1 | 7/2003 | Okamoto | 345/90 |
| 2007/0040785 | A1 | 2/2007 | Edwards et al. | 345/92 |
| 2007/0279366 | A1 | 12/2007 | Kageyama et al. | 345/100 |
| 2008/0158117 | A1 * | 7/2008 | Wong et al. | 345/87 |
| 2008/0238953 | A1 * | 10/2008 | Ogura | 345/697 |
| 2009/0284500 | A1 * | 11/2009 | Yamashita | 345/204 |

FOREIGN PATENT DOCUMENTS

| | | | |
|---|---|---|---|
| GB | 2271458 | A | 4/1994 |
| JP | 2009006284 | | 1/1997 |
| JP | 2004151222 | | 5/2004 |
| KR | 20040063344 | A | 7/2004 |
| WO | WO 2008/100369 | A1 | 8/2008 |
| WO | WO 2008/156553 | A1 | 12/2008 |

OTHER PUBLICATIONS

"33.5L Late News Paper: Dynamic Self-Refreshing Memory-in-Pixel Circuit for Low Power Standby Mode in Mobile LIPS TFFT-LCD", Philips Mobile Display Systems, ISSN/0004-0966X/04/3502, (2004), pp. 1096-1099.

* cited by examiner

*Primary Examiner* — Lixi C Simpson
(74) *Attorney, Agent, or Firm* — Harrington & Smith

(57) ABSTRACT

In accordance with an example embodiment of the present invention, an apparatus comprising a data control line configured to comprise data for subsequent viewing on a display. Further, the apparatus comprises a refresh control line configured to update at least one pixel on a display; a frequency based selector coupled to the refresh control line; and a memory coupled to the frequency based selector and the data control line. The apparatus is configured to provide one or more signals to a pixel in a first mode of operation and a second mode of operation based at least in part on the refresh control line.

19 Claims, 4 Drawing Sheets

METHOD AND APPARATUS FOR DISPLAYING ONE OR MORE PIXELS

TECHNICAL FIELD

The present application relates generally to displaying one or more pixels.

BACKGROUND

An electronic device may have a display to view content. Further, there may be different types of displays. As such, the electronic device facilitates use different displays.

SUMMARY

Various aspects of examples of the invention are set out in the claims.

According to a first aspect of the present invention, an apparatus comprises a data control line configured to comprise data for subsequent viewing on a display. Further, the apparatus comprises a refresh control line configured to update at least one pixel on a display; a frequency based selector coupled to the refresh control line; and a memory coupled to the frequency based selector and the data control line. The apparatus is configured to provide one or more signals to a pixel in a first mode of operation and a second mode of operation based at least in part on the refresh control line.

According to a second aspect of the present invention, a method comprises updating at least one pixel on a display using a refresh control line and providing one or more signals to a pixel in a first mode of operation and a second mode of operation using the refresh control line.

BRIEF DESCRIPTION OF THE DRAWINGS

For a more complete understanding of example embodiments of the present invention, reference is now made to the following descriptions taken in connection with the accompanying drawings in which.

DETAILED DESCRIPTION OF THE DRAWINGS

An example embodiment of the present invention and its potential advantages are understood by referring to FIGS. 1 through 5 of the drawings.

Figure 1:
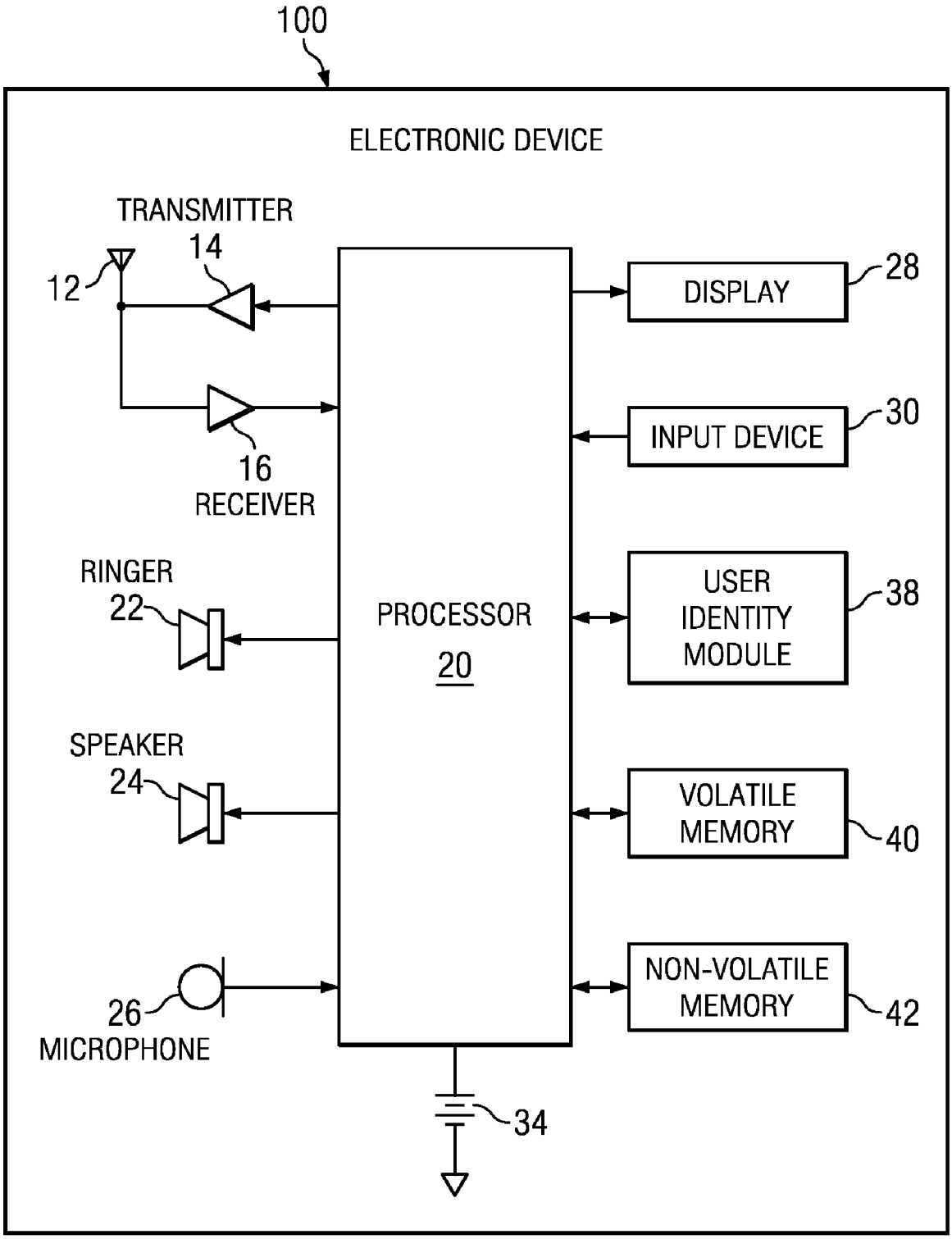
FIG. 1 is a block diagram depicting an electronic device operating in accordance with an example embodiment of the invention.

FIG. 1 is a block diagram depicting an electronic device 100 operating in accordance with an example embodiment of the invention. In an example embodiment, an electronic device 100 comprises at least one antenna 12 in communication with a transmitter 14, a receiver 16, and/or the like. The electronic device 100 may further comprise a processor 20 or other processing component. In an example embodiment, the electronic device 100 may comprises multiple processors, such as processor 20. The processor 20 may provide at least one signal to the transmitter 14 and may receive at least one signal from the receiver 16. In an embodiment, the electronic device 100 may also comprise a user interface comprising one or more input or output devices, such as a conventional earphone or speaker 24, a ringer 22, a microphone 26, a display 28, and/or the like. In an embodiment, an input device 30 comprises a mouse, a touch screen interface, a pointer, and/or the like. In an embodiment, the one or more output devices of the user interface may be coupled to the processor 20. In an example embodiment, the display 28 is configured to be a touch screen, a liquid crystal display, and/or the like.

In an embodiment, the electronic device 100 may also comprise a battery 34, such as a vibrating battery pack, for powering various circuits to operate the electronic device 100. Further, the vibrating battery pack may also provide mechanical vibration as a detectable output. In an embodiment, the electronic device 100 may further comprise a user identity module (UIM) 38. In one embodiment, the UIM 38 may be a memory device comprising a processor. The UIM 38 may comprise, for example, a subscriber identity module (SIM), a universal integrated circuit card (UICC), a universal subscriber identity module (USIM), a removable user identity module (R-UIM), and/or the like. Further, the UIM 38 may store one or more information elements related to a subscriber, such as a mobile subscriber.

In an embodiment, the electronic device 100 may comprise memory. For example, the electronic device 100 may comprise volatile memory 40, such as random access memory (RAM). Volatile memory 40 may comprise a cache area for the temporary storage of data. Further, the electronic device 100 may also comprise non-volatile memory 42, which may be embedded and/or may be removable. The non-volatile memory 42 may also comprise an electrically erasable programmable read only memory (EEPROM), flash memory, and/or the like. In an alternative embodiment, the processor 20 may comprise memory. For example, the processor 20 may comprise volatile memory 40, non-volatile memory 42, and/or the like.

In an embodiment, the electronic device 100 may use memory to store any of a number of pieces of information and/or data to implement one or more features of the electronic device 100. Further, the memory may comprise an identifier, such as international mobile equipment identification (IMEI) code, capable of uniquely identifying the electronic device 100. The memory may store one or more instructions for determining cellular identification information based at least in part on the identifier. For example, the processor 20, using the stored instructions, may determine an identity, e.g., cell id identity or cell id information, of a communication with the electronic device 100.

In an embodiment, the processor 20 of the electronic device 100 may comprise circuitry for implementing audio feature, logic features, and/or the like. For example, the processor 20 may comprise a digital signal processor device, a microprocessor device, a digital to analog converter, other support circuits, and/or the like. In an embodiment, control and signal processing features of the processor 20 may be allocated between devices, such as the devices describe above, according to their respective capabilities. Further, the processor 20 may also comprise an internal voice coder and/or an internal data modem. Further still, the processor 20 may comprise features to operate one or more software programs. For example, the processor 20 may be capable of operating a software program for connectivity, such as a conventional Internet browser. Further, the connectivity program may allow the electronic device 100 to transmit and receive Internet content, such as location-based content, other web page content, and/or the like. In an embodiment, the electronic device 100 may use a wireless application protocol (WAP), hypertext transfer protocol (HTTP), file transfer protocol (FTP) and/or the like to transmit and/or receive the Internet content.

In an embodiment, the electronic device 100 may be capable of operating in accordance with any of a number of a first generation communication protocol, a second generation communication protocol, a third generation communication protocol, a fourth generation communication protocol, and/or the like. For example, the electronic device 100 may be capable of operating in accordance with second generation (2G) communication protocols IS-136, time division multiple access (TDMA), global system for mobile communication (GSM), IS-95 code division multiple access (CDMA), and/or the like. Further, the electronic device 100 may be capable of operating in accordance with third-generation (3G) communication protocols, such as Universal Mobile Telecommunications System (UMTS), CDMA2000, wideband CDMA (WCDMA), time division-synchronous CDMA (TD-SCDMA), and/or the like. Further still, the electronic device 100 may also be capable of operating in accordance with 3.9 generation (3.9G) wireless communication protocols, such as Evolved Universal Terrestrial Radio Access Network (E-UTRAN) or the like, or wireless communication projects, such as long term evolution (LTE) or the like. Still further, the electronic device 100 may be capable of operating in accordance with fourth generation (4G) communication protocols.

In an alternative embodiment, the electronic device 100 may be capable of operating in accordance with a non-cellular communication mechanism. For example, the electronic device 100 may be capable of communication in a wireless local area network (WLAN), other communication networks, and/or the like. Further, the electronic device 100 may communicate in accordance with techniques, such as radio frequency (RF), infrared (IrDA), any of a number of WLAN techniques. For example, the electronic device 100 may communicate using one or more of the following WLAN techniques: IEEE 802.11, e.g., 802.11a, 802.11b, 802.11g, 802.11n, and/or the like. Further, the electronic device 100 may also communicate, via a world interoperability, to use a microwave access (WiMAX) technique, such as IEEE 802.16, and/or a wireless personal area network (WPAN) technique, such as IEEE 802.15, BlueTooth (BT), ultra wideband (UWB), and/or the like.

It should be understood that the communications protocols described above may employ the use of signals. In an example embodiment, the signals comprises signaling information in accordance with the air interface standard of the applicable cellular system, user speech, received data, user generated data, and/or the like. In an embodiment, the electronic device 100 may be capable of operating with one or more air interface standards, communication protocols, modulation types, access types, and/or the like. It should be further understood that the electronic device 100 is merely illustrative of one type of electronic device that would benefit from embodiments of the invention and, therefore, should not be taken to limit the scope of embodiments of the invention.

While embodiments of the electronic device 100 are illustrated and will be hereinafter described for purposes of example, other types of electronic devices, such as a portable digital assistant (PDA), a pager, a mobile television, a gaming device, a camera, a video recorder, an audio player, a video player, a radio, a mobile telephone, a traditional computer, a portable computer device, a global positioning system (GPS) device, a GPS navigation device, a GPS system, a mobile computer, a browsing device, an electronic book reader, a combination thereof, and/or the like, may be used. While several embodiments of the invention may be performed or used by the electronic device 100, embodiments may also be employed by a server, a service, a combination thereof, and/or the like. It should be understood that example embodiments may be part of an integrated circuit, part of a circuit module comprising one or more integrated circuits, and/or the like.

Figure 2:
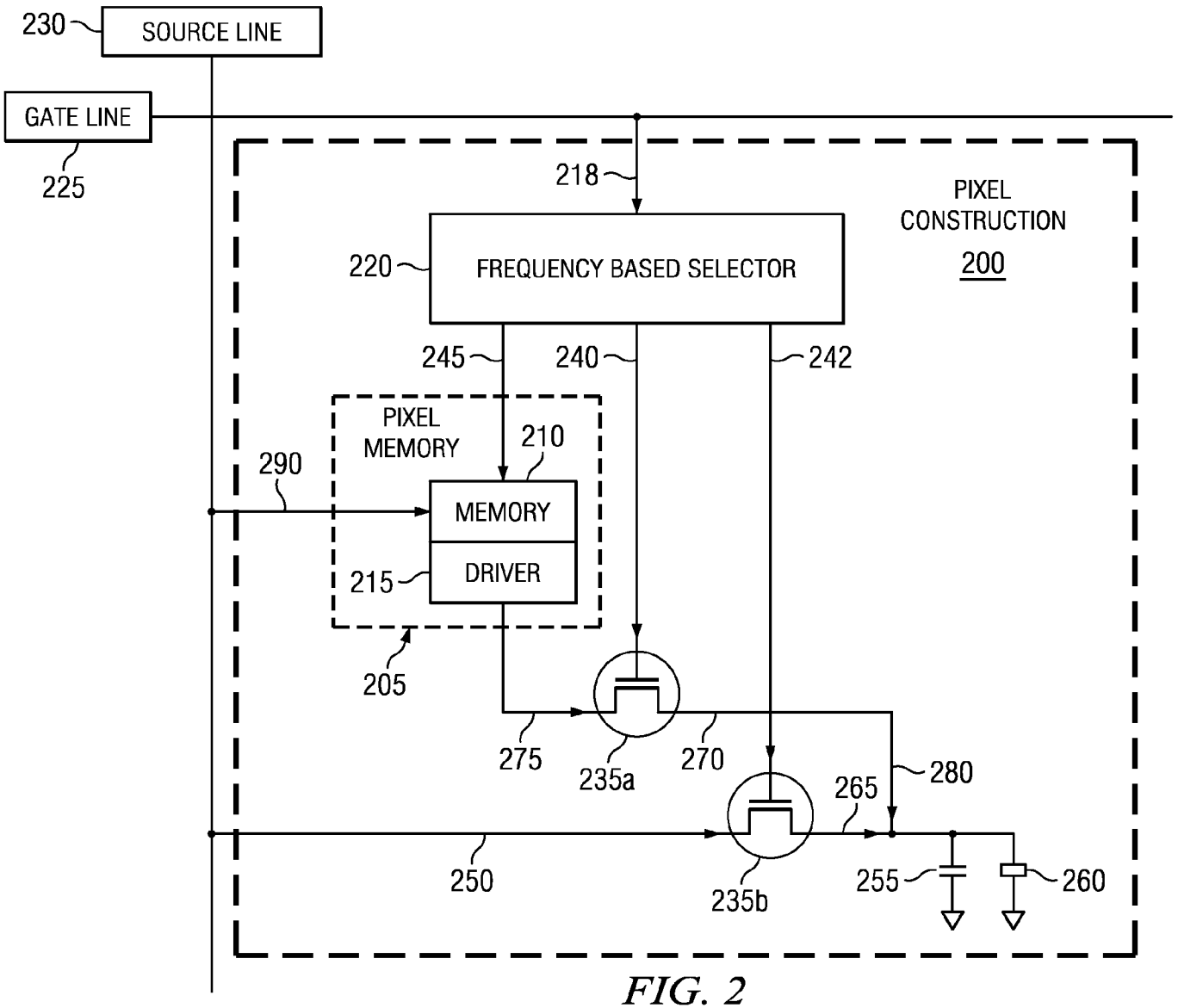
FIG. 2 is a block diagram of a pixel construction in accordance with an example embodiment of the invention.

FIG. 2 is a block diagram of a pixel construction 200 in accordance with an example embodiment of the invention. In an example embodiment, the pixel construction 200 comprises pixel memory 205, one or more transistors 235*a*, 235*b*, and/or a frequency based selector 220. In an embodiment, a gate line 225 is coupled and/or in communication with the frequency based selector 220. In an embodiment, the gate line 225 is also referred to as a data control line.

In an embodiment, an output refreshing signal 218 is configured to control the frequency based selector 220. In an example embodiment, the frequency based selector 220 output refreshes a signal 245 to the pixel memory 205. In an embodiment, the frequency based selector 220 output control signals outputs 240, 242 to one or more transistors 235*a*, 235*b*, which may operate as a switch. In an example embodiment, the frequency based selector 220 is configured to select the pixel memory, e.g., memory in pixel mode, based at least in part on a low frequency. In an embodiment, the memory in pixel mode is at least one of about 10 Hertz, about 100 milliseconds per frame, about 100 milliseconds per 480 lines, and about 0.208 milliseconds per line. In an alternative embodiment, the frequency based selector 220 is configured to select a normal mode based at least in part on a high frequency. In an embodiment, the normal mode is at least one of about 60 Hertz, about 16.6 milliseconds per frame, about 16.6 milliseconds per 480 lines, and about 0.03458 milliseconds per line.

In an embodiment, the pixel memory 205 receives communication from a source line 230. In an embodiment, the pixel memory 205 comprises at least one memory 210 and/or at least one driver 215. In an example embodiment, the pixel construction may be part of an electronic device, such as electronic device 100 of FIG. 1. In an embodiment, the pixel memory is controlled by the frequency based selector 220 via output refreshing signal 245.

In an example embodiment, the frequency based selector 220 is configured to make a mode selection based at least in part on voltage differences, e.g., gate line 225 or source line 230 voltage and/or refresh rate differences of the gate line 225 or source line 230 detected on the pixel. For example, the frequency based selector 220 detects different refresh rate between the gate line 225 and the pixel. In an alternative, embodiment, the frequency based selector 220 is configured to make a selection based in part on at least one of the following: vertical timing and horizontal timing.

The frequency based selection is based at least in part on time on gate line, e.g., when it is selected is, for example, high voltage. Consider the following example. Selected gate line time is 0.208 ms implies memory in pixel mode is used; selected gate line is 0.03458 ms=normal mode is used. It should be understood that it is possible to implement a trigger point, e.g. 0.1 ms in this case, when over 0.1 ms implies memory in pixel mode and less than 0.1 ms means normal mode.

In an embodiment, an input 218 of the frequency based selector 220 includes a logic relating to detection '0' is Normal mode and '1' is memory in pixel mode. The input 218 may also include a device, which may charge and discharge e.g. a capacitor. A voltage level of the capacitor may be based at least in part on the selected gate time. Consider the following example. If gate line 225 changes the capacitor a voltage level, logic detects '1' the memory in pixel mode is selected otherwise the normal mode is selected.

In an embodiment, the frequency based Selector 220 may include two or more inputs, which are connected to the input 218. For example, one of the inputs detects that gate line 225 is selected and another input detects what is the selected gate line time.

In an example embodiment, a memory in pixel mode comprises at least one active transistor and at least one inactive transistor. For example, the transistor 235*a* is active and the transistor 235*b* is inactive in the memory in pixel mode. The transistor 235*a* is controlled by the frequency based selector 220 via the control line 240. Further, the transistor 235*a* receives pixel information from the pixel memory 205 via a control line 275. The transistor 235*a* sends the pixel information to a pixel capacitor 255 and/or a liquid crystal 260 via a control line 270. In such a case, the liquid crystal 260 displays one or more pixels based on the pixel information. Restated, the one or more pixels are refreshed from a pixel memory 205. In an alternative example embodiment, one or more pixels in the capacitor 255 and/or liquid crystal 260 are refreshed from pixel memory via control lines 275, 280 directly.

In an example embodiment, a normal mode comprises at least one active transistor and at least one inactive transistor. For example, the transistor 235*b* is active and the transistor 235*a* is inactive in normal mode. The transistor 235*b* is controlled by the frequency based selector 220 via a control line 242. Further, the transistor 235*b* receives pixel information from Source line 230 via control line 250. The transistor 235*b* sends pixel information to pixel capacitor 255 and liquid crystal 260 via control line 265. In an alternative example embodiment, one or more pixels in the capacitor 255 and/or liquid crystal 260 are refreshed from the source line 230 via control lines 250, 265 directly. Further, the pixel memory 205 is updated from the source line 230 via control line 290 and the pixel memory 205 is controlled via control line 245. In an example embodiment, control lines 240, 242, 245, 250, 265, 270, 275, 280, 290 may be referred to as a refresh control line. A technical effect of one or more of the example embodiments disclosed herein is that there are no separated control lines for memory in pixel mode feature.

In an example embodiment, an apparatus comprises a data control line configured to comprise data for subsequent viewing on a display. Further, the apparatus comprises a refresh control line configured to update at least one pixel on a display; a frequency based selector coupled to the refresh control line; and a memory coupled to the frequency based selector and the data control line. The apparatus is configured to provide one or more signals to a pixel in a first mode of operation and a second mode of operation based at least in part on the refresh control line.

In an alternative embodiment, an apparatus comprises an electronic device with a pixel construction. In an embodiment, the apparatus comprises at least one processor and at least one memory including computer program code. The at least one memory and the computer program code configured to, with the at least one processor, cause the apparatus to perform at least the following: a gate line coupled to the frequency based selector 220, the frequency based selector 220 is configured to determine a frequency at a gate line 225 without use of separate control line; the frequency based selector 220 is further configured to select at least one of memory in pixel mode or normal mode based at least in part on the frequency; and a display to update one or more pixels based at least in part on the selection.

It should be understood that a technical effect of one or more of the example embodiments disclosed herein is using a frequency based selector 220 to select a mode based at least in part on frequency. Another technical effect of one or more of the example embodiments disclosed herein is using a frequency based selector 220 to select a mode based at least in part on refresh rate.

Figure 3:
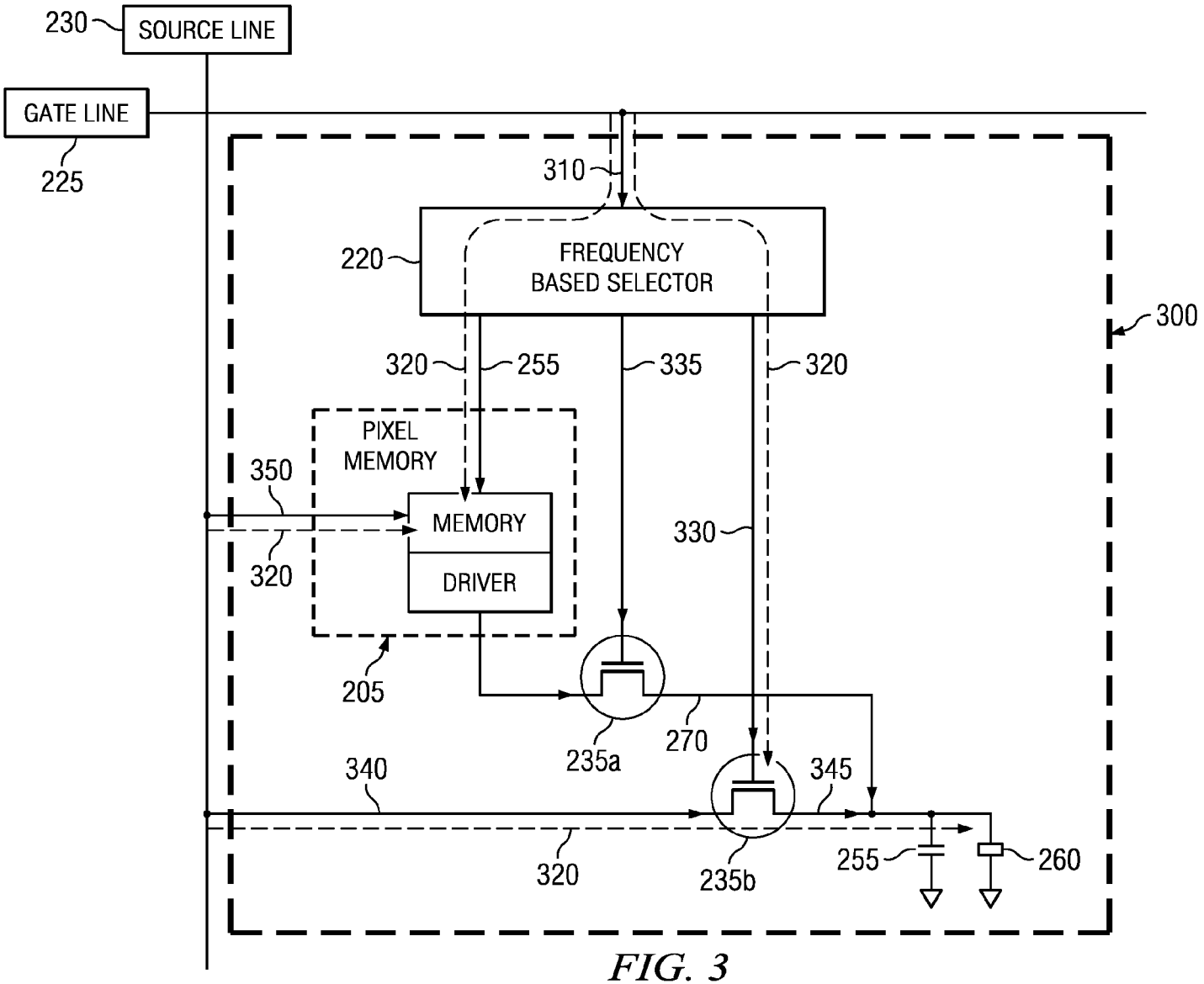
FIG. 3 is a pixel construction operating in normal mode in accordance with an example embodiment of the invention.

FIG. 3 is a pixel construction operating in normal mode in accordance with an example embodiment of the invention.

In an example embodiment, a pixel construction 300 comprises pixel memory 205, one or more transistors 235*a*, 235*b*, and/or a frequency based selector 220. In an embodiment, a gate line 225 is coupled and/or in communication with the frequency based selector 220. In an embodiment, a source line 230 is in communication with the pixel memory 205 and/or at least one transistor, such as transistor 235*b*.

In an example embodiment, the frequency based selector 220 determines an inputted frequency on the line 310. In an example embodiment, the frequency based selector 220 selects a mode, such as normal mode or memory in pixel mode based at least in part on the frequency. For example, the frequency based selector 220 selects normal mode with a frequency of about 60 Hz. In such a case, components are activated over the line 320.

In an example embodiment, a normal mode comprises at least one active transistor and at least one inactive transistor. For example, the transistor 235*b* is active and the transistor 235*a* is inactive in normal mode. That is, control signal 330 is active and control signal 335 is inactive. In such a case, a capacitor 255 and a liquid crystal 260 by the source line 230 via control signals 340, 345. Further, the pixel memory 205 is updated by the source line 230 via control line 350. In an embodiment, the pixel memory 205 is controlled via control line 255.

In an example embodiment, normal mode is a mode which is used different grey levels of the pixel, e.g. 256 levels, for a high frequency, e.g. about 60 Hz, to keep a selected grey level on the pixel. In an embodiment, normal mode is used for moving images, such as video clips, when the higher response of the pixels are needed.

Figure 4:
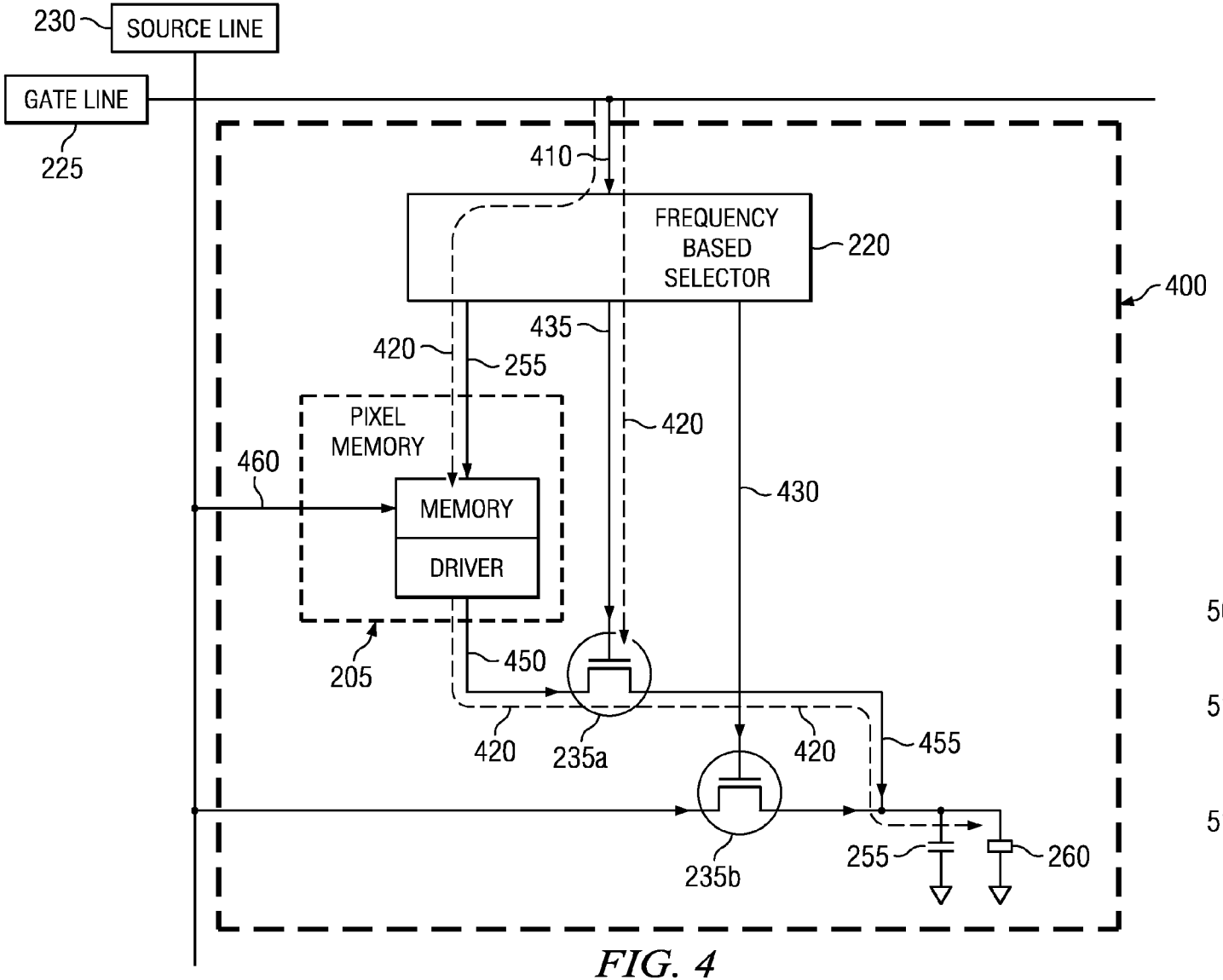
FIG. 4 is a pixel construction operating in memory in pixel mode in accordance with an example embodiment of the invention.

FIG. 4 is a pixel construction operating in memory in pixel mode in accordance with an example embodiment of the invention.

In an example embodiment, a pixel construction 400 comprises pixel memory 205, one or more transistors 235*a*, 235*b*, and/or a frequency based selector 220. In an embodiment, a gate line 225 is coupled and/or in communication with the frequency based selector 220. In an embodiment, a source line 230 is in communication with the pixel memory 205 and/or at least one transistor, such as transistor 235*b*.

In an example embodiment, the frequency based selector 220 determines an inputted frequency on the line 410. In an example embodiment, the frequency based selector 220 selects a mode, such as normal mode or memory in pixel mode based at least in part on the frequency. For example, the frequency based selector 220 selects memory in pixel mode with a frequency of about 10 Hz. In such a case, components are activated over the line 420.

In an example embodiment, a memory in pixel mode comprises at least one active transistor and at least one inactive transistor. For example, the transistor 235*a* is active and the transistor 235*b* is inactive in memory in pixel mode. That is, control signal 435 is active and control signal 430 is inactive. In such a case, a capacitor 255 and a liquid crystal 260 are updated using the pixel memory 205 via control signals 450, 455. Further, the pixel memory 205 is not updated by the source line 230 via control line 460. In an embodiment, the pixel memory 205 is controlled via control line 255. In this way, one or more pixels may be updated without use of additional control lines.

Figure 5:
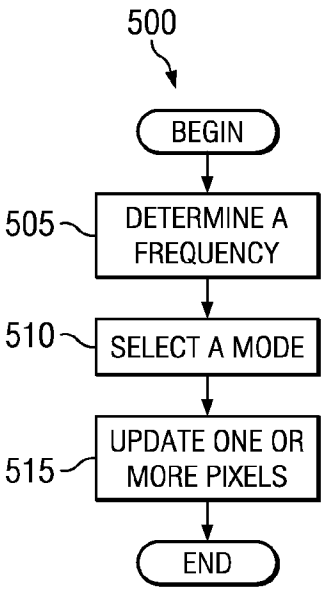
FIG. 5 is a flow diagram illustrating an example method for updating one or more pixels on a display.

FIG. 5 is a flow diagram illustrating an example method for updating one or more pixels on a display. Example method 500 may be performed by an electronic device, such as electronic device 100 of FIG. 1.

At 505, at frequency is determined. In an example embodiment, a frequency based selector, such as frequency based selector 220 of FIG. 2, determines a frequency at a gate line, such as gate line 225 of FIG. 2, without use of separate control line. For example, the frequency based selector determines a low frequency at the gate line using the existing control line.

At 510, a mode is selected. In an example embodiment, the frequency based selector is configured to select at least one of memory in pixel mode or normal mode based at least in part on the frequency. For example, the frequency based selector 220 selects memory in pixel mode with a frequency of about 10 Hz.

At 515, one or more pixels are updated. In an example embodiment, a capacitor, such as capacitor 255 of FIG. 2, and a liquid crystal, such as liquid crystal 260 of FIG. 2, are updated using a source line, such as source line 230 of FIG. 2.

Without in any way limiting the scope, interpretation, or application of the claims appearing below, a technical effect of one or more of the example embodiments disclosed herein is that there are no separated control lines for memory in pixel mode feature. Another technical effect of one or more of the example embodiments disclosed herein is using a frequency based selector to select a mode based at least in part on frequency. Another technical effect of one or more of the example embodiments disclosed herein is using a frequency based selector to select a mode based at least in part on refresh rate.

Embodiments of the present invention may be implemented in software, hardware, application logic or a combination of software, hardware and application logic. The software, application logic and/or hardware may reside on an electronic device or a computer. If desired, part of the software, application logic and/or hardware may reside on an electronic device and part of the software, application logic and/or hardware may reside on a computer. In an example embodiment, the application logic, software or an instruction set is maintained on any one of various conventional computer-readable media. In the context of this document, a "computer-readable medium" may be any media or means that can contain, store, communicate, propagate or transport the instructions for use by or in connection with an instruction execution system, apparatus, or device, such as a computer, with one example of a computer described and depicted in FIGS. 3-4. A computer-readable medium may comprise a computer-readable storage medium that may be any media or means that can contain or store the instructions for use by or in connection with an instruction execution system, apparatus, or device, such as a computer.

If desired, the different functions discussed herein may be performed in a different order and/or concurrently with each other. Furthermore, if desired, one or more of the above-described functions may be optional or may be combined.

Although various aspects of the invention are set out in the independent claims, other aspects of the invention comprise other combinations of features from the described embodiments and/or the dependent claims with the features of the independent claims, and not solely the combinations explicitly set out in the claims.

It is also noted herein that while the above describes example embodiments of the invention, these descriptions should not be viewed in a limiting sense. Rather, there are several variations and modifications which may be made without departing from the scope of the present invention as defined in the appended claims.

What is claimed is:

1. A display panel comprising:

a source line comprising data for subsequent viewing on a display;

a data control line configured to carry control data to manage the subsequent viewing the data on the display; and a plurality of pixels, each pixel having a construction comprising:

a frequency based selector configured to monitor the data control line and to provide instructions for a first mode of operation and a second mode of operation based on the monitoring;

a memory coupled to the frequency based selector and the source line, and responsive at least in part to the instructions; and where in the first mode the pixel is updated with the data from the memory and in the second mode the pixel and the memory are updated from the source line;

two or more refresh control lines configured to update the pixel in the first mode of operation with the data from the memory and configured to update the pixel and the memory in the second mode of operation from the source line.

2. The apparatus of claim 1, wherein the first mode of operation corresponds to the memory in a pixel mode and the second mode of operation corresponds to a normal mode.

3. The apparatus of claim 2, wherein the frequency based selector is configured to select the memory in the pixel mode based at least in part on a low frequency of a control signal on the data control line.

4. The apparatus of claim 2 wherein the construction of each pixel with the memory in the pixel mode comprises at least one active transistor and at least one inactive transistor configured to assist in updating said each pixel.

5. The apparatus of claim 1 wherein the frequency based selector is configured to select a normal mode based at least in part on a high frequency of a control signal on the data control line.

6. The apparatus of claim 1, wherein the frequency based selector is controlled by a control signal.

7. The apparatus of claim 1, wherein each pixel is refreshed using the memory.

8. The apparatus of claim 1 wherein the construction of each pixel in the second mode of operation comprises at least one active transistor and at least one inactive transistor.

9. The apparatus of claim 1, wherein the frequency based selector is configured to make a selection between the first or second mode of operation based in part on at least one of the following: vertical timing and horizontal timing of the data control line.

10. An electronic device comprising a display panel of claim 1.

11. A method comprising:

configuring, by a frequency based selector of each pixel construction comprising one pixel of a display panel and coupled to a data control line, instructions for a first mode of operation and a second mode of operation based on monitoring of the data control line, and providing the instructions at least to a memory in the each construction, the memory being coupled to a frequency based selector and a source line, where the source line comprising data for subsequent viewing of data on a display and the data control line configured to carry control data to manage the subsequent viewing of the data on the display; and updating, using two or more refresh control lines, the one pixel in the first mode of operation with the data from the memory or updating the one pixel and the memory in the second mode of operation from the source line.

12. The method of claim 11, wherein the first mode of operation corresponds to the memory in a pixel mode and the second mode of operation corresponds to a normal mode.

13. The method of claim 12 wherein the memory in the pixel mode is based at least in part on a low frequency of a control signal on the data control line.

14. The method of claim 12 further comprising activating at least a first transistor and deactivating at least a second transistor with the memory in the pixel mode.

15. The method of claim 12, further comprising activating at least one transistor and deactiving at least another transistor in the normal mode.

16. The method of claim 11 wherein selecting the normal mode is based at least in part on a high frequency of a control signal on the data control line.

17. The method of claim 11 further comprising controlling the frequency based selector using a control signal.

18. The method of claim 11, further comprising refreshing the at least one pioxel using the memory.

19. The method of claim 11, further comprising selecting between the first or second mode of operation using a frequency based selector based at least in part on at least one of the following: vertical timing and horizontal timing of the data control line.

* * * * *